United States Patent [19]

Hoshi et al.

[11] Patent Number: 4,769,672

[45] Date of Patent: Sep. 6, 1988

[54] ELECTROPHOTOGRAPHIC PROCESS

[75] Inventors: Nobuyoshi Hoshi, Katsuta; Masayasu Anzai, Hitachi, both of Japan

[73] Assignee: Hitachi, Ltd., Tokyo, Japan

[21] Appl. No.: 91,754

[22] Filed: Sep. 1, 1987

[30] Foreign Application Priority Data

Sep. 1, 1986 [JP] Japan ..... 61-203702

[51] Int. Cl.[4] ..... G03G 15/04

[52] U.S. Cl. ..... 355/4; 355/3 BE; 355/3 DR

[58] Field of Search ..... 355/4, 3 BE, 3 DR, 3 R, 355/14 D

[56] References Cited

U.S. PATENT DOCUMENTS

| | | | |
|---|---|---|---|
| 4,068,942 | 1/1978 | Pennell | 355/3 DR X |
| 4,231,652 | 11/1980 | Moser et al. | 355/3 DR |
| 4,370,047 | 1/1983 | Damouth et al. | 355/4 X |
| 4,480,906 | 11/1984 | Titus et al. | 355/4 X |
| 4,531,828 | 7/1985 | Hoshino | 355/4 X |
| 4,569,584 | 2/1986 | St. John et al. | 355/4 X |
| 4,592,641 | 6/1986 | Roelofs et al. | 355/3 BE X |

FOREIGN PATENT DOCUMENTS 54-134439 10/1979 Japan .

*Primary Examiner*—A. C. Prescott

*Attorney, Agent, or Firm*—Antonelli, Terry & Wands

[57] ABSTRACT

A recording member (10) consists, for example, of one endless film-like belt that is folded in a recessed shape. A plurality of printing portions (1–4) are disposed in such a manner as to face the outer peripheral surface of the belt. This recording member is developed simultaneously by toners having different colors. The toner image is transferred to recording paper by transfer units that are disposed in such a manner as to face the upper projecting portion of the belt while interposing therebetween the recording paper that moves linearly along the upper part of the printing portions (1–5, 2–5, 3–5, 4–5).

5 Claims, 1 Drawing Sheet

ELECTROPHOTOGRAPHIC PROCESS

FIELD OF THE INVENTION

This invention relates to an electrophotographic process and more particularly to a printing process which will be suitable for multi-color or full-color printing.

BACKGROUND OF THE INVENTION

A conventional full-color printing method is disclosed, for example, in FIG. 1 of Japanese Patent Laid-Open No. 134439/1979 entitled "COLOR ELECTROPHOTOGRAPHIC COPYING MACHINE" laid open to public on Oct. 18, 1979. In accordance with this prior art reference, a plurality of photoreceptor drums corresponding to three primary colors of cyanate (C), Magenta (M) and yellow (Y) or to the three primary colors of (C), (M), (Y) plus black (B) are disposed independently and after a toner image is formed simultaneously on each of these photoreceptor drums, each toner image is transferred in order onto transfer paper moving linearly. In the electrophotographic copying machine of this kind, degradation of each photoreceptor member is likely to occur non-uniformly because a plurality of photoreceptor drums are disposed, and a printing position error is therefore likely to occur on the transfer paper.

SUMMARY OF THE INVENTION

It is an object of the present invention to provide an electrophotographic process which can make multi-color printing by use of a single photosensitive drum in the same period of time as required for monochromic printing and which can make compact an apparatus as a whole.

The object of the invention described above can be accomplished by forming simultaneously a toner image of each color at a different position on an endless film-like recording member that is folded, and transferring the image while moving transfer paper sequentially and linearly.

DESCRIPTION OF THE PREFERRED EMBODIMENTS

Figure 1:
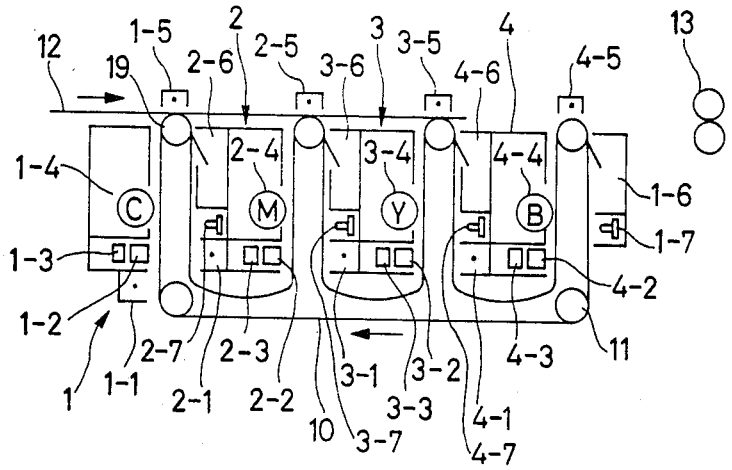
FIG. 1 is a side view of a full-color printing machine in one embodiment of the present invention.

Referring to FIG. 1, a recording member belt 10 made of an organic photoconductor is moved while being driven by a roller 11 for driving the belt 10. The recording member belt 10 is conveyed while being bent in a concaved form as shown in the drawing, and first, second, third and fourth printing portions 1, 2, 3 and 4 are disposed along its outer peripheral portion. The recording member belt 10 is charged uniformly by a charging device 1-1 and the rays of light emitted from an LED array light source 1-3 on the basis of printing signals are radiated to the recording member belt 10 through a rod lens array 1-2 to form an electrostatic latent image thereon. The latent image is developed by a cyanate toner of a first developing machine 1-4. The toner image thus formed is transferred to paper 12 by a transfer unit 1-5. Each of the second, third and fourth printing portions 2, 3 and 4 consists of an exposure unit consisting of a charging device 2-1, 3-1, 4-1, a rod lens array 2-2, 3-2, 4-2 and an LED array light source 2-3, 3-3, 4-3, a developing machine 2-4, 3-4, 4-4 containing the Magenta toner, the yellow toner and the black toner, a transfer unit 2-5, 3-5, 4-5, a cleaner 2-6, 3-6, 4-6 and an eraser lamp 2-7, 3-7, 4-7, 1-7 in the same way as the first printing portion 1.

Charging, exposure and development are carried out in the second, third and fourth printing portions 2, 3 and 4 in synchronism with the charging, exposure and developing steps in the first printing portion 1. In this case, the printing process in the second, third and fourth printing portions is sequentially deviated by the image formation time so that the toner images formed after the paper 12 has passed sequentially through the transfer units 1-5, 2-5, 3-5, 4-5 overlap exactly with one another and form a full-color image.

The toners remaining on the recording member belt 10 after transfer are removed by the cleaner lamps 2-6, 3-6, 4-6, 1-6 and the residual charge of the toner is then erased by the erasers 2-7, 3-7, 4-7, 1-7. By the time when the paper 12 passes through the transfer unit 1-5, the next printing process has already been started in the first printing portion 1. The full-color image thus formed on the paper is fixed by heat rollers.

Since full-color printing can be made while the recording paper 12 moves linearly between transfer unit 1-5, 2-5, 3-5, 4-5 and a paper conveyor roller 19, this embodiment provides the effect that multi-color printing can be made at the same printing speed as monochromic printing. Since a single recording member belt is used, there can be obtained the effect that no position error occurs when the toner images are sequentially superposed. Furthermore, the printing portion of each color is disposed along the outer peripheral surface of the recording member belt which is bent in a concave form, the embodiment provides the effects that no dead space exists and the apparatus can be made more compact as a whole. When a plurality of photoreceptor drums are used, degradation of each photoreceptor drum does not occur at the same time.

Figure 2:
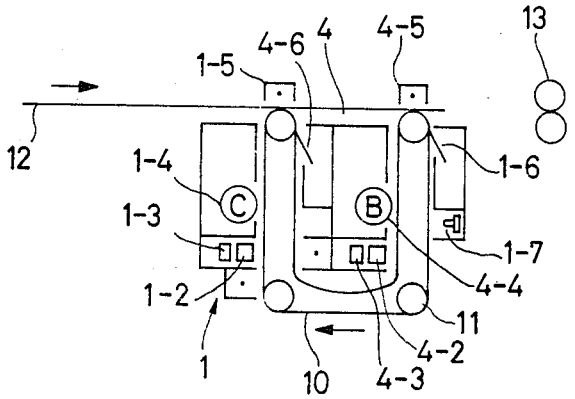
FIG. 2 is a side view of a two-color printing machine in another embodiment of the present invention.

FIG. 2 shows a two-color printing process consisting of the first printing portion 1 and the fourth printing portion 4 shown in FIG. 1. In accordance with this embodiment, two-color printing can be made at the same printing speed as the monochromic printing in various combinations of colors by changing the first developing machine 1-4 of the first printing portion 1 and the fourth developing machine 4-4 of the fourth printing portion 4 by developing machines having toners of other colors.

In the embodiments described above, the recording member belt 10 is made of an organic photo-conductor, but organic and inorganic photo-conductors can be used without specific limitation so long as they can be shaped in the belt form. It is also possible to use an organic film having no photoconductivity for the recording member belt 10 and an ion radiation array for forming the electrostatic latent image by ion radiation in place of the exposure unit consisting of the rod lens array and the LED array. In such a case, the charging device and the eraser become unnecessary and it is advisable to use an A.C. corona charge remover in place of the eraser. Furthermore, it is possible to form a magnetic latent image in place of the electrostatic latent image and to develop it by a magnetic toner having a different color. In the first embodiment, it is further possible to use a liquid crystal shutter array in place of the LED array light source. If the charging device, the exposure unit, the developing machine, the cleaner and the eraser to be inserted into the inner peripheral surface of the recess of the recording member in such a manner as to face the recording member are assembled in the unit construction, the assembly and production of the apparatus become easier. Moreover, the first developing machine in this embodiment contains the cyanate toner but since a sufficient space can be secured with respect to the outer wall surface of the recess, a developing machine having a greater size can be disposed and a toner having the highest use frequency (such as black) is preferably used.

Figure 3:
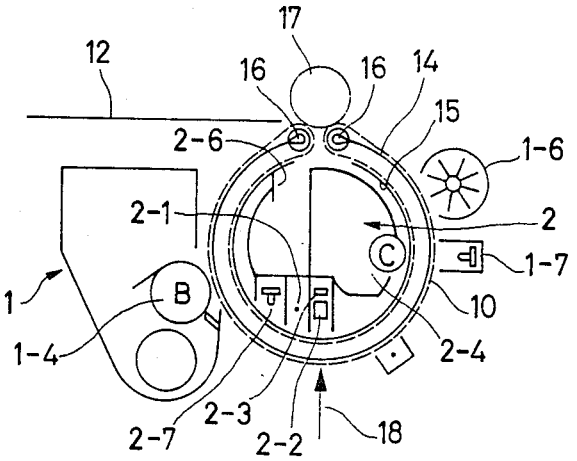
FIG. 3 is a side view of another embodiment of the present invention.

FIG. 3 shows a third embodiment of the present invention. Though the recording member 10 is conveyed in the substantially concave form in the first and second embodiments, it is conveyed through a cylindrically folded path by a cylinder 14 and a guide 15. The recording member 10 is conveyed by driving at least one of two conveyor rollers 16. The recording member 10, the conveyor rollers 16, the cylinder 14 and the guide 15 are assembled in the cassette form so that the recording member 10 can be replaced easily. The first printing portion containing the black toner that is used most frequently is disposed outside the cylinder 14 having a wide space, and exposure is made by a laser beam 18. The second printing portion containing the color toner is incorporated in the cylinder 14. The two conveyor rollers constituting the transfer unit are disposed close to each other, and the black toner image and the color toner image formed on the surface of the recording member 10 are transferred simultaneously to the paper 12 by one transfer roller 17 to obtain a two-color image.

In accordance with the present invention, one recording member belt is conveyed along at least one recess and the printing portion is placed inside the recess so that a plurality of toner images can be superposed with one another when the recording paper passes. Therefore, the multi-color or full-color image can be obtained at the same printing speed as monochromic printing. Furthermore, since the printing portion is fitted into the recess of one belt photosensitive member, it has no dead space and the apparatus can be made compact as a whole. Furthermore, a position error of printing becomes difficult to occur. Since the number of photoreceptor drum is one, the drawback of the prior art, that degradation of each color photoreceptor drum occur at the same time, can be resolved by the embodiment.

What is claimed is:

1. An electrophotographic process which develops sequentially an electrostatic latent image formed on the surface of a recording member (10) by toners of different colors and transferring sequentially the resulting toner images onto recording paper in superposition to obtain a multi-color or full-color image, characterized in that said recording member is shaped in an endless belt-like form and is conveyed in a bent and folded path, a plurality of printing portions (1-4) are disposed along the outer peripheral surface of said belt-like recording member and there are disposed transfer units (1-5, 2-5, 3-5, 4-5) for sequentially transferring the resulting toner images on recording paper (12) moving linearly along the upper part of said path.

2. The electrophotographic process according to claim 1, wherein said recording member is formed in a substantially continuous recessed shape, and a first printing portion (2, 3, 4) constituted in a unit structure is disposed inside said recess in such a manner as to face the inner peripheral surface of said recess of said recording member.

3. The electrophotographic process according to claim 1, wherein said belt-like recording member is driven by conveyor rollers (16) disposed along the outer peripheral surface of a cylinder (14) having one of its end open and a guide (15) having a smaller diameter than said cylinder and disposed substantially concentrically with said cylinder, a second printing portion (1) is disposed outside said cylinder in such a manner as to face said recording member and a third printing portion (2) having a unit structure is assembled inside said guide.

4. The electrophotographic process according to claim 2, wherein a second printing portion (1) is disposed on the outer peripheral surface of said recess of said recording member.

5. The electrophotographic process according to claim 3, wherein one transfer roller for transferring multiple colors to said recording paper is disposed in such a manner as to face said conveyor rollers (17).

* * * * *